United States Patent [19]

Johnson

[11] 3,987,957

[45] Oct. 26, 1976

[54] ONE PIECE SIMPLEX CARTON

[75] Inventor: Fred J. Johnson, Long Beach, Calif.

[73] Assignee: Container Corporation of America, Chicago, Ill.

[22] Filed: Oct. 31, 1975

[21] Appl. No.: 627,594

[52] U.S. Cl. ..... 229/31 FS; 229/36; 229/34 R

[51] Int. Cl.[2] ..... B65D 5/24

[58] Field of Search ..... 229/31 I, 33, 34 R, 229/36

[56] References Cited

UNITED STATES PATENTS

| | | | |
|---|---|---|---|
| 1,726,682 | 9/1929 | Scholes | 229/34 R |
| 1,886,879 | 11/1932 | Gross | 229/34 R |
| 1,905,119 | 4/1933 | Newton | 229/34 R |
| 3,246,740 | 4/1966 | Guyer | 229/33 X |
| 3,355,086 | 11/1967 | Ingle | 229/31 FS |
| 3,545,665 | 12/1970 | Nimaroff | 229/36 X |

*Primary Examiner*—Davis T. Moorhead

*Attorney, Agent, or Firm*—Carpenter & Ostis

[57] ABSTRACT

A one-piece collapsible carton formed of a unitary blank of foldable paperboard and comprising integral tray and cover portions which may be formed and glued and then shipped in a knocked down condition to the ultimate user.

4 Claims, 6 Drawing Figures

ONE PIECE SIMPLEX CARTON

SUMMARY OF THE INVENTION

The invention relates to folding cartons, and particularly to folding cartons used as retail packages by department stores and other similar business operations.

Traditionally department stores have used two-piece set-up or two-piece collapsed cartons for retail packages; whereas, one-piece cartons offer many advantages. A primary advantage of the one-piece carton is the elimination of the problems created by the necessity of matching covers and trays, both from the standpoint of maintaining an equal number of each and from the standpoint of insuring that the lacquer or color is identical for both tops and bottoms.

It is, therefore, an object of this invention to provide, in a one-piece carton of the type described, a structure which has integral tray and cover portions and which can be pre-glued on a straight line gluer for shipment in a collapsed condition for either manual or automatic erection.

It is a more specific object of the invention to provide, in a carton of the type described, a structural arrangement wherein certain of the walls of the tray portion are pre-glued in such a manner that the remaining walls can be folded into position therewith to provide an erected carton.

It is a further object of this invention to provide a one piece carton which is considerably less expensive, faster to erect and has equal or better appearance than a conventional two piece retail store carton.

These and other objects of the invention will be apparent from an examination of the following description and drawings:

THE DRAWINGS

FIG. 1 of a plan view of the inside surface of a blank of foldable sheet material from which the carton illustrated in the other views may be formed;

Figure 4:
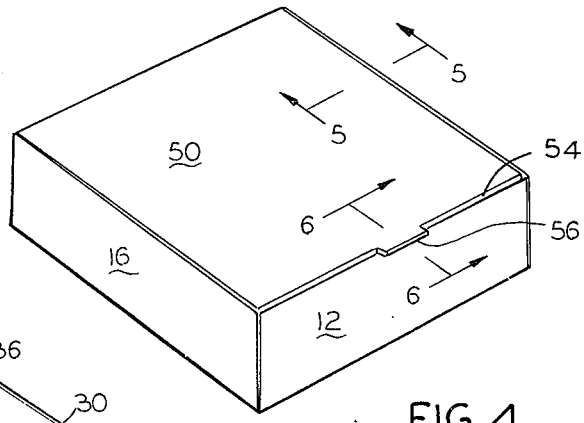
Figure 6:
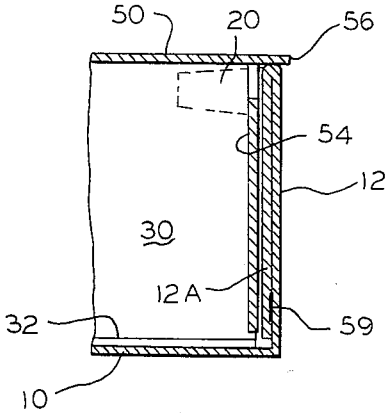
Figure 5:
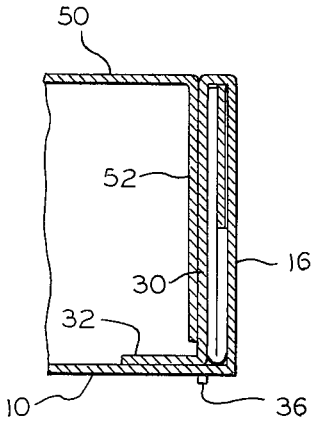

FIG. 4 is a perspective view of the carton completely erected with the cover shown in a closed condition; and FIGS. 5 and 6 are vertical sections taken on lines 5—5 and 6—6 respectively, of the structure illustrated in FIG. 4.

It will be understood that for purposes of clarity, certain elements may have been intentionally omitted from certain views where they are believed to be illustrated to better advantage in other views.

Figure 1:
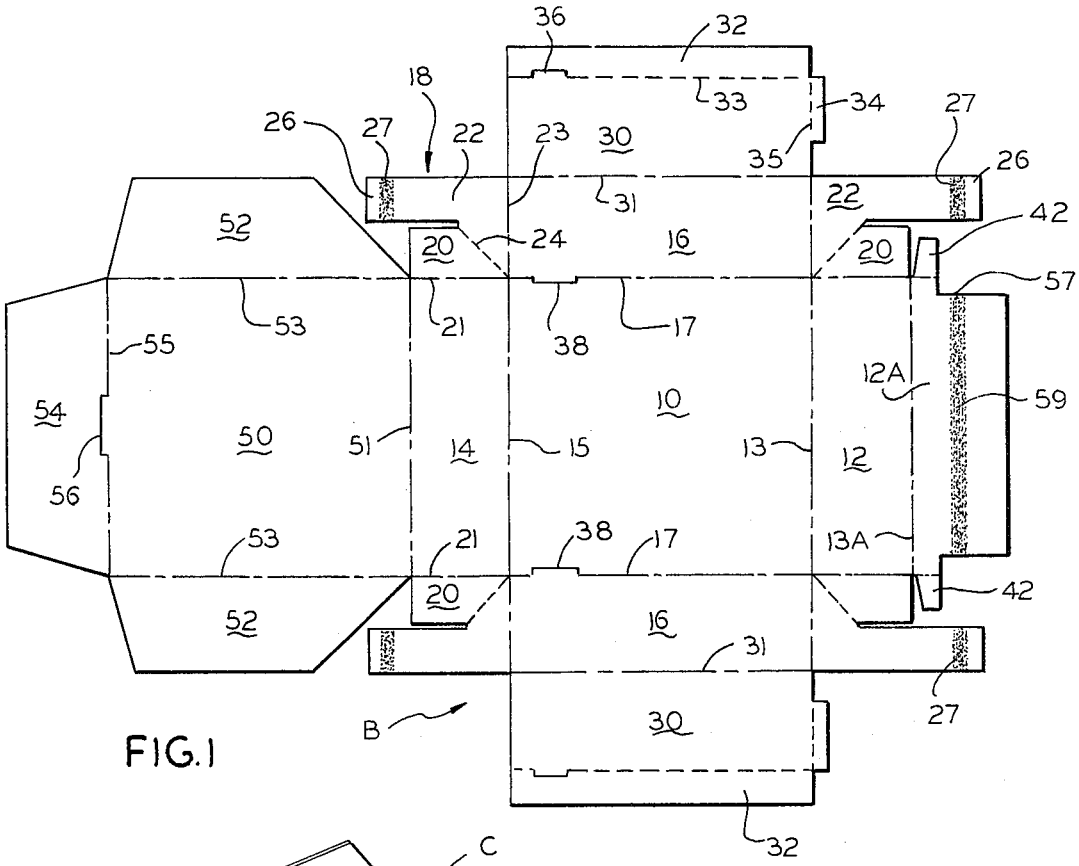

Referring now to the drawing for a better understanding of the invention, it will be seen that the carton, indicated generally at C and illustrated in FIGS. 2 through 5, is a one piece structure which may be formed from a unitary blank indicated generally at B, of foldable paperboard which is illustrated in FIG. 1.

Figure 2:
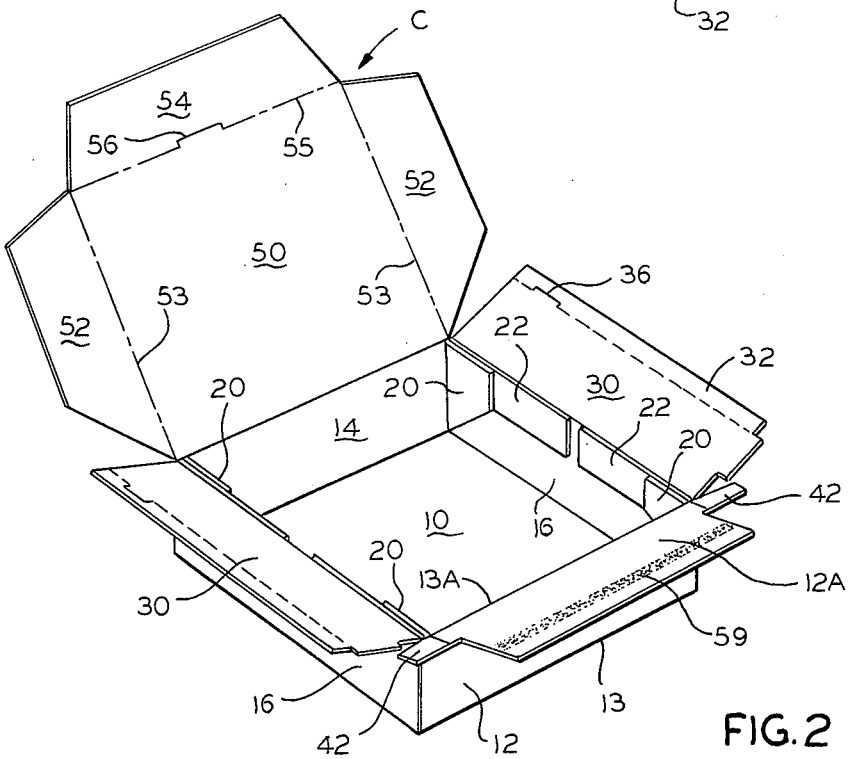
FIG. 2 is a perspective view of the carton embodying features of the invention shown with a cover portion in an open condition and with the tray portion in a partially erected condition.
Figure 3:
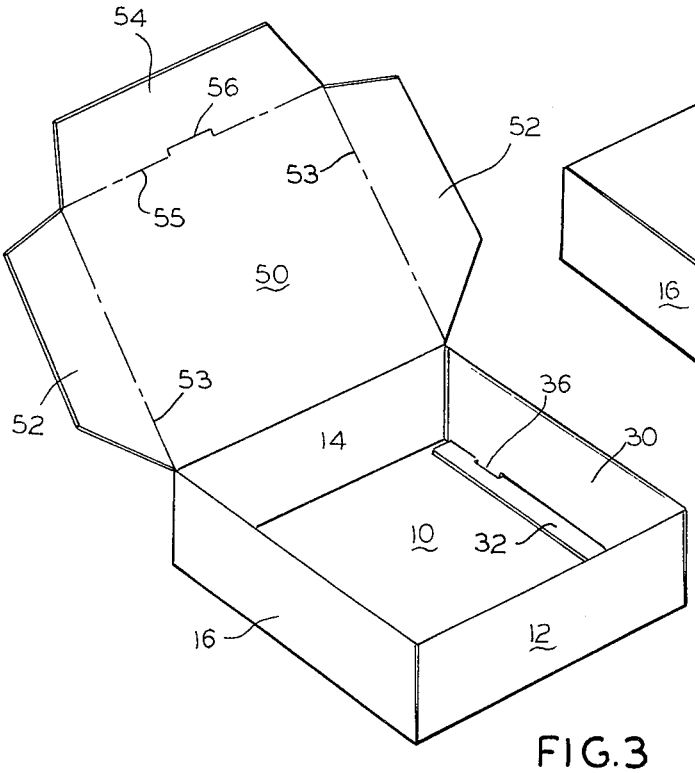
FIG. 3 is a view similar to FIG. 2 but with the tray portion shown in a completely erected condition.

Referring now to FIGS. 1 and 2, it will be seen that the carton includes integral tray and cover portions which are hingedly attached in a manner hereinafter described.

The tray portion of the carton includes a generally rectangular flat bottom wall 10 with opposed pairs of front and rear side walls and end walls connected thereto and upstanding therefrom to form therewith a box-like structure open at the top. The front side wall includes an outer panel 12, foldably connected at its lower edge to the front edge of bottom wall 10 on fold line 13 and an inner panel 12A foldably connected at its upper edge on fold line 13A to the upper edge of outer panel 12. The rear side wall includes a single panel 14 foldably connected at its lower edge to the rear edge of bottom wall 10 on fold line 15.

Each of the end walls includes an outer panel 16 foldably connected at its lower edge along fold line 17 to an end edge of bottom wall 10 and an inner panel 30 foldably connected at its upper edge along fold line 31 to the upper edge of outer panel 16.

At the corner of the tray portion, the front and rear side walls are connected at their ends to adjacent end portions of related end walls by means of corner gusset members indicated generally at 18.

Each of the gusset members includes a first gusset element 20, foldably connected along fold line 21 to an end edge of rear wall and a second gusset element 22 foldably connected along fold line 23 to an adjacent edge of a related end wall inner panel 16. First and second gusset elements are connected to each other along a diagonal fold line 24 which extends outwardly from a related corner of bottom wall 10. It will be noted that each of the second gusset elements 22 includes an extension or projection 26 which is adhesively secured to the related side wall inner panel by means of adhesives indicated generally at 27.

Foldably connected to the lower edge of each end wall inner panel 30 along fold line 33 is a retaining flap 32 which is disposed to lie on top of the inner surface of bottom wall 10 when the carton is in erected condition with the inner and outer panels of the end walls folded in face-to-face relationship. In order to maintain the end walls in erected condition, there may be provided at the lower edge of each inner panel 30 a projection 36 adapted to be received within a complementary recess 38 in the bottom wall 10. Additionally, in order to afford a locking relationship between the end walls and the front side wall, there may be provided on each end wall inner panel a locking projection 34 hingedly attached on fold line 35 to the forward edge of inner panel 30.

The front wall inner panel 12A may be provided at each end thereof with projection 42, the purpose of which is hereinafter described, and also with an end recess 57, the purpose of which is to receive the retaining lock extension 34 of the related end wall inner panel in a manner hereinafter described.

The cover portion of the carton includes a generally rectangular top panel 50, foldably connected at its rear edge along fold line 51 to the upper edge of rear side wall 14. Foldably connected to opposite side edges of top wall 50 along fold line 53 are a pair of side tuck flaps 52. Also foldably connected along fold line 55 to the front edge of top wall 50 is a front tuck flap 54. At its front edge top wall 50 is provided with a slight extension or projection 56 adapted to rest on the upper edge of the front side wall when the carton is closed, as best seen in FIG. 4.

In forming the carton it will be noted that the glue areas 27 on the gusset elements 22 and the glue areas 59 on the front side wall inner panel 12A all extend in the same direction so that the carton may be glued on a straight line gluer in the carton manufacturer's plant. This is, of course, a less expensive gluing operation than a carton which has to be glued on a right angle gluer. In forming the carton after the glue has been applied to the areas referred to, the front inner panel 12A is folded inwardly 180° about fold line 13A to adhesively secure the inner face of front side wall inner panel 12A to the inner face of front side wall outer panel 12. Next, front side wall outer panel 12 is folded inwardly 180° about fold line 13 and rear side wall 14 is folded inwardly 180° about fold line 15 to secure the extension 26 of the second gusset member 22 to the inner faces of related end wall outer panels 16.

At this point the carton is completely glued and ready to be shipped in a collapsed or flattened condition. In order to erect the carton the front and rear side walls are reverse folded outwardly 90° which automatically brings the end wall outer panels also up to 90°. Thereafter the end wall inner panels are folded inwardly and downwardly 180° until they are in face-to-face engagement with their related outer panels with the lock tabs 36 being received within locking apertures 38 and with locking tabs 34 being received within locking apertures 57. It will be in order that during the formation of the carton the extensions 42 off the ends of the front side wall inner panel 12A are folded between the inner and outer panels of the end wall to afford more rigidity at the upper areas of the front corner of the carton. After the carton has been filled, the cover, front and side tuck flaps 54 and 52 are folded inwardly 90° and the cover front wall is folded downwardly to close the carton with the retaining tab 56 resting on the upper edge of the carton front side wall.

Thus it will be appreciated that the novel carton design provides a clean, simplistic structural arrangement for a collapsible one-piece carton formed from a unitary blank of paperboard.

I claim:

1. In a one piece carton having tray and cover portions formed from a unitary blank of foldable sheet material such as paperboard, the combination of:

a. a tray portion including a bottom wall, opposed pairs of front and rear side walls and end walls upstanding therefrom, and gusset means interconnecting said side and end walls at the corners of said tray portion to form a box-like structure open at the top;

b. said end walls each including an outer panel foldably connected at its lower edge to a side edge of said bottom wall and an inner panel foldably connected at its upper edge to an upper edge of said outer panel and extending downward toward said bottom wall;

c. said front side wall including an outer panel foldably connected at its lower edge to a front edge of said bottom wall and an inner panel foldably connected at its upper edge to an upper edge of said outer panel and extending downward toward said bottom wall and being adhesively secured to said outer panel;

d. said gusset means each including a pair of gusset elements foldably connected to adjacent edges of a side and end wall respectively, at a corner of said tray portion;

e. the gusset elements which are connected to said end walls being folded inwardly thereagainst and having extensions which are adhesively secured between the inner and outer panels of said end walls;

f. said end wall gusset extensions being long enough to have end portions which extend beyond the upper edges of said front and rear side walls when the carton is in a collapsed condition to facilitate the application of adhesive;

g. said rear side wall comprising a single panel being foldably connected at its lower edge to a rear edge of said bottom wall;

h. said cover portion including a top wall foldably connected at its rear edge to an upper edge of said rear side wall, a front flap, and a pair of side flaps foldably connected at their upper edges to front and side edges of said top wall and disposed to lie against the surfaces of said front side wall and said end walls respectively, when the carton is closed.

2. A carton, according to claim 1, wherein each of said end wall inner panels has a locking tab projecting below its lower edge for receipt within a complementary opening in said bottom wall.

3. A carton, according to claim 1, wherein said front side wall inner panel has at its edges recesses for receiving complementary shaped locking tabs extending from adjacent side edges of related end wall inner panels.

4. A carton, according to claim 1, and including a retaining tab projecting from the front edge of said top wall and designed to lie on the upper edge of said front side wall when the carton is closed.

* * * * *